US008550700B2

(12) United States Patent
Wiederrecht

(10) Patent No.: US 8,550,700 B2
(45) Date of Patent: Oct. 8, 2013

(54) CLOCK MOVEMENT CONTAINING A CONSTANT FORCE DEVICE

(75) Inventor: Jean-Marc Wiederrecht, Bernex (CH)

(73) Assignee: Agenhor S.A., Meyrin (CH)

( * ) Notice: Subject to any disclaimer, the term of this patent is extended or adjusted under 35 U.S.C. 154(b) by 42 days.

(21) Appl. No.: 13/119,956

(22) PCT Filed: Jul. 30, 2009

(86) PCT No.: PCT/EP2009/059902
§ 371 (c)(1),
(2), (4) Date: Jun. 13, 2011

(87) PCT Pub. No.: WO2010/031631
PCT Pub. Date: Mar. 25, 2010

(65) Prior Publication Data

US 2011/0235474 A1 Sep. 29, 2011

(30) Foreign Application Priority Data

Sep. 18, 2008 (EP) ..... 08105371

(51) Int. Cl.
*G04B 18/00* (2006.01)

(52) U.S. Cl.
USPC ..... 368/186; 368/200

(58) Field of Classification Search
USPC ..... 368/186, 200
See application file for complete search history.

(56) References Cited

U.S. PATENT DOCUMENTS 1,237,216 A 8/1917 Oeth
2,324,163 A 7/1973 Jaccard
6,863,434 B2 * 3/2005 Mojon ..... 368/127
6,997,602 B2 * 2/2006 Mojon et al. ..... 368/127
7,293,912 B2 11/2007 Girardin et al.
7,473,027 B2 * 1/2009 Goeller ..... 368/124
8,038,340 B2 * 10/2011 Schneider ..... 368/124
2007/0147179 A1 6/2007 Girardin et al.

FOREIGN PATENT DOCUMENTS

CH 19 839 A 9/1900

OTHER PUBLICATIONS

Written Opinion of International Search Authority, mailed Apr. 14, 2011, for International Application No. PCT/EP2009/059902, 6 pages.
International Search Report, mailed Oct. 19, 2009, for International Application No. PCT/EP2009/059902.
European Search Report, dated Mar. 24, 2009, for European Application No. EP 08105371.2.

* cited by examiner

*Primary Examiner* — Sean Kayes
(74) *Attorney, Agent, or Firm* — Finnegan, Henderson, Farabow, Garrett & Dunner, LLP

(57) ABSTRACT

A clock movement is provided that contains a constant force device. In accordance with one implementation, the clock movement includes a spiral spring, and a train, having a first kinematic chain arranged to connect a main energy source to a first end of the spiral spring and a second kinematic chain for connecting a time base to a second end of the spiral spring. One of the first and second kinematic chains may contain an adjustment mobile comprising first and second members connected to each other by a friction such that a rotation of one member drives the other member during routine working of the clock movement. One of these members may include an adjustment member having at least one bearing surface arranged such that it is possible to act upon the latter so as to rotate the adjustment member without rotating the other member by dint of friction, in order to adjust the load state of the spiral spring.

20 Claims, 5 Drawing Sheets

CLOCK MOVEMENT CONTAINING A CONSTANT FORCE DEVICE

This application is a national stage filing under 35 U.S.C. §371 of International Application No. PCT/EP2009/059902, filed on Jul. 30, 2009, which claims priority to European Application No. 08105371.2, filed on Sep. 18, 2008, the disclosures of which are expressly incorporated herein by reference to their entireties.

BACKGROUND

1. Technical Field

The present invention relates to a clock movement containing a constant force device, comprising a spiral spring, and a train, having a first kinematic chain arranged to connect a main energy source to a first end of the spiral spring and a second kinematic chain for connecting a time base to a second end of the spiral spring.

2. Prior Art

Numerous clock movements of the abovementioned type, containing constant force devices, have long been described.

By way of example, U.S. Pat. No. 1,237,216, describes a clock movement containing a primary mainspring, of sizeable power reserve, and a secondary mainspring, of lesser power reserve, the secondary mainspring having the advantage of delivering a substantially constant torque all the way along its extent. Thus the secondary spring is utilized to supply energy to a time base, while the primary spring allows the secondary spring to be periodically reloaded without the variations in delivered torque which it exhibits as a function of its load state disturbing the running of the time base. By means of an actuating mechanism driven from the train of the movement, the periodic release of one end of the secondary spring may be controlled to allow the latter to be reloaded.

A few decades later, movements of this type have been adapted for use in pocket watches or in wristwatches.

These small-sized movements are complex and hence tricky to assemble. In particular, the amplitude of the oscillations of the mechanical oscillator, critical for the running accuracy of the movement, is difficult to adjust, particularly as it depends on the load state of the secondary spring. The adjustment of the running, which is tricky, must thus be carried out by the clockmaker at the point of assembly of the movement, especially by adjustment of the initial load state of the secondary spring. When the operation has to be realized later, within the framework of the after-sales service, it has again the same complexity.

Swiss Patent 19839, granted on Aug. 4, 1899, had already presented this problem and proposed a solution. It was envisioned to provide a plurality of holes in the wheel bearing one end of the secondary spring. Thus, by disposing the end of the secondary spring in one hole or another, it was possible to vary its load state.

Nevertheless, the adjustment of the load state of the secondary spring by means of this mechanism remains perilous, in particular when the movement is running.

After several decades of neglect at the end of the 20th. century, constant force devices seem once again to offer a certain interest for prestigious clock-making factories.

Thus, for example, U.S. Pat. No. 7,293,912 B2 was granted on Nov. 13, 2007 in the name of the company Lange Uhren GmbH. It is nevertheless notable that this constant force device, though of complex construction, does not propose means by which the load state of the secondary spring can be easily adjusted.

SUMMARY

Disclosure of the Invention

Consistent with embodiments of the present invention, a clock movement is provided that contains a constant force device of simple construction, which as far as possible limits the disturbances, linked to its working, which could influence the running of the time base of the movement and the load state of the secondary spring of which can be adjusted in a precise and simple manner.

To this end, the mechanism according to one embodiment of the present invention satisfies the characteristics set out above and may be further arranged such that one or other of the first and second kinematic chains contains an adjustment mobile comprising first and second members connected to each other by a friction such that a rotation of one member drives the other member during routine working of the clock movement. Moreover, one of these members may be an adjustment member having at least one bearing surface arranged such that it is possible to act upon the latter so as to rotate the adjustment member without rotating the other member by dint of friction, in order to adjust the load state of the spiral spring.

According to an embodiment, the watchmaker may act upon the movement in order to regulate the load state of the spiral spring relatively easily, even when the movement is running. In fact, unlike known mechanisms, there is no need to remove any element whatever of the movement in order to regulate the load state of the spiral spring.

According to an embodiment, the clock movement is such that the adjustment mobile may comprise a main shaft kinematically connected to the main energy source, a stop wheel rotationally fixed to this shaft and bearing a fixing element fixed to the first end of the spiral spring, the adjustment member, having the form of a shaft mounted coaxially and in a freely rotatable manner in relation to the main shaft and having a fixing element for the second end of the spiral spring, the second member, having the form of a drive wheel frictionally mounted on the adjustment member and kinematically connected to the time base.

The adjustment mobile may fulfil the function of the third mobile of the movement.

In addition, it is advantageously provided that the movement contains a stop device arranged to lock the stop wheel in a predefined angular position and to periodically release it to allow reloading of the spiral spring from the main energy source, according to a predefined amplitude, via the main shaft and the stop wheel.

Moreover, the adjustment member may have a circular periphery provided with a knurling or a toothing forming the bearing surface, while the movement may further contain a control mobile adjacent to the adjustment mobile and comprising a toothed pinion capable of cooperating with this bearing surface.

According to an embodiment, the toothed pinion may be translationally movable between a first rest position, in which it is disengaged from the bearing surface, and a second adjustment position, in which it engages with the bearing surface.

Moreover, with a view to simplifying the operations relating to the load state of the spiral spring, the control mobile may be provided with at least one slot suitable for cooperating with a tool in order to rotate the toothed pinion.

It is to be understood that both the foregoing general description and the following detailed description are exemplary and explanatory only and are not restrictive of the present disclosure, as claimed.

The accompanying drawings, which are incorporated in and constitute a part of this specification, illustrate embodiments of the present disclosure and together with the description, serve to explain the principles of the present disclosure.

BRIEF DESCRIPTION OF THE DRAWINGS

Other characteristics and advantages of the present invention will become more clearly apparent from a reading of the following detailed description of a preferred embodiment, which description is made with reference to the appended drawings given by way of non-limiting examples and in which.

DETAILED DESCRIPTION

Embodiment(s) of the Invention

Figure 1:
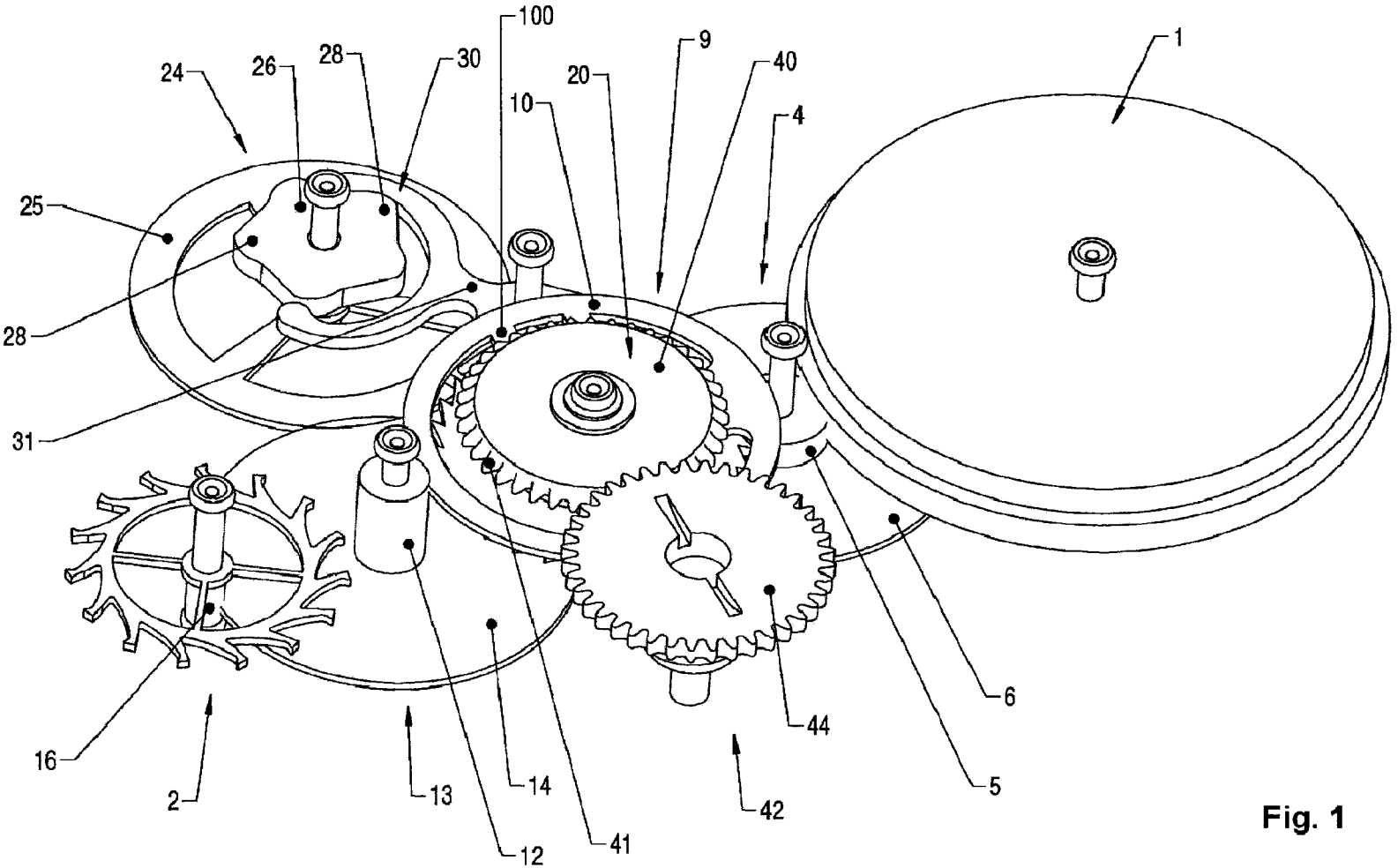
FIG. 1 represents a simplified perspective view of a clock movement containing a constant force device according to an embodiment of the invention.
Figure 2:
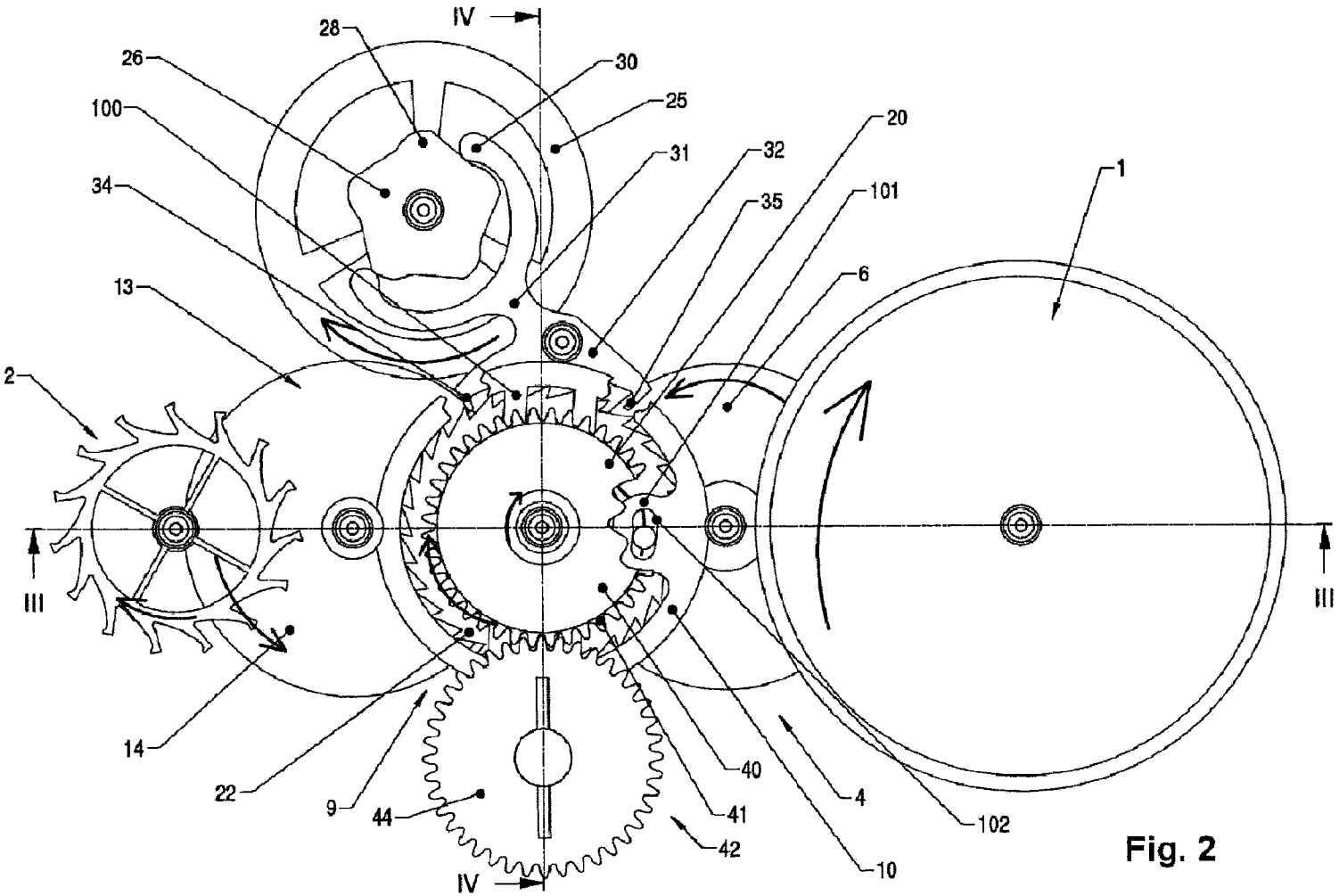
FIG. 2 represents a simplified plan view from above of the clock movement of FIG. 1.
Figure 3:
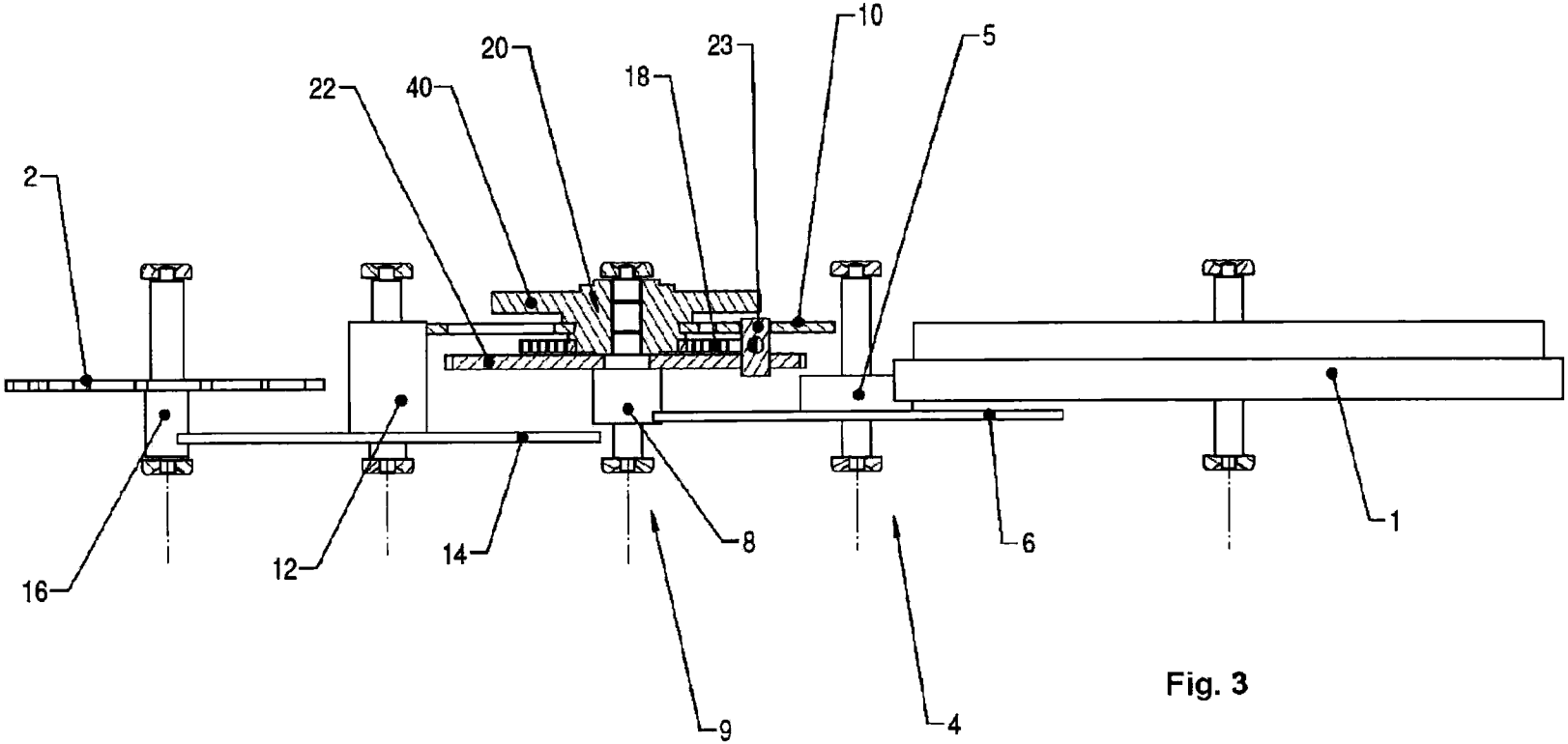
FIG. 3 represents a simplified sectional view of the clock movement along the plane III-III of FIG. 2.

The structure and general working of an embodiment of the present invention will be explained in association with FIGS. 1, 2 and 3, representing the movement respectively in perspective, in plan view and in section. Only those elements which contribute to an understanding of the invention are illustrated, for greater clarity. Certain elements of FIG. 2 are shown in partially cut-away representation in order to make visible other elements which are superimposed on them.

According to an embodiment, a clock movement containing constituent members has been illustrated in FIGS. 1 to 3, in particular a barrel 1 accommodating a mainspring (non-visible) and designed to supply energy to the mechanical oscillations of a time base of which only the escape wheel 2 has been represented. The energy of the mainspring is transmitted via a work train comprising a centre mobile 4, the pinion 5 of which is in mesh with the toothing of the barrel drum and the wheel 6 of which is in mesh with the pinion 8 of a third mobile 9. The wheel 10 of the third mobile is, for its part, in mesh with a pinion 12 of a first seconds mobile 13, the wheel 14 of which is in mesh with the escape pinion 16.

Moreover, the clock movement according to an embodiment of the present invention contains a constant force device designed to transmit a constant force to the time base from the force which it receives from the mainspring, which force varies appreciably as a function of the winding of the latter.

More precisely, the constant force device may comprises a secondary spring 18 in the form of a spiral spring. This is mounted on the third mobile 9 with a first of its ends, the inner end, fixed to an adjustment member 20, the working of which will be described later, mounted in a freely rotatable manner on the shaft of the third mobile 9 and bearing the third wheel 10. The second end, the outer end, of the spiral spring 18 is fixed to a stop wheel 22 via a stud 23, the stop wheel being rotationally fixed to the shaft of the third mobile 9.

The constant force device likewise comprises a second seconds mobile 24, the wheel 25 of which engages with the wheel 14 of the first seconds mobile 13, in a ratio of 1/1 by way of non-limiting illustration. The shaft of the second seconds mobile 24 bears a cam 26 having five bosses 28, which cam is rotationally fixed to the shaft. Here the cam 26 thus makes a turn on itself every sixty seconds.

The cam 26 cooperates with a first fork 30 of a control pallet 31 mounted pivotably on a frame element of the movement (non-visible) between two end positions.

The control pallet 31 comprises a second fork 32 arranged to cooperate with a serrated toothing of the stop wheel 22. The second fork bears two pallet stones 34 and 35 disposed such that, when the pallet pivots, one of the pallet stones being in contact with the toothing of the stop wheel 22, this pallet stone disengages from the toothing, thus releasing the stop wheel, which here performs a rotation of twelve degrees (since the toothing has thirty teeth, by way of non-limiting illustration) before another tooth abuts against the other pallet stone, which has meanwhile positioned itself within reach of the toothing of the stop wheel 22. Hence the pallet stones ensure the alternating locking of the stop wheel, which latter advances by one step each time it passes from one pallet stone to the other.

It will be noted that the period of the alternations can likewise be adjusted by the choice of shape of the cam 26, especially the number of its bosses 28. In the case of the represented figure, each complete turn of the cam 26 gives rise to ten pivots of the pallet 31. In other words, the stop wheel 22 is released every six seconds.

The working of the clock movement with constant force device, which clock movement has just been described, is explained below.

Starting from the principle that the spiral spring 18 has a non-zero load state, the mechanical oscillator (a conventional hairspring, for example) being in oscillations state, the spiral spring transmits a portion of its mechanical energy to the mechanical oscillator via the third wheel 10, the first seconds mobile 13, the escape pinion 16 and the escape wheel 2.

After six seconds of working, the pallet 31 pivots under the effect of its cooperation with the cam 26 and releases the stop wheel 22, fixed to the shaft of the third mobile 9, the third mobile being kept under tension by the mainspring, via the centre mobile 4. The stop wheel 22 then performs a twelve degree rotation, as explained above, taking with it the stud 23 and hence the outer end of the spiral spring 18 (in the direction of the arrow indicated in FIG. 2). The spiral spring is thus reloaded every six seconds by a relative displacement between its inner end—fixed during the release of the stop wheel 22—and its outer end through an angle of twelve degrees.

Of course, the gear ratios of the work train may be chosen such that the third wheel 10 passes through an angle of twelve degrees during the six seconds separating two successive loads of the spiral spring 18, that is to say that this wheel makes a complete turn on itself in three minutes. By virtue of these characteristics, the spiral spring 18 each time accumulates a quantity of energy from the mainspring corresponding to that which it has transmitted to the mechanical oscillator of the movement during the previous six seconds.

This value of six seconds is indicative and the person skilled in the art will have no particular difficulty in adapting the present teaching to his own needs, given that the condition which has to be met here in order to ensure optimal working of the device, is a range of relative displacement between the two ends of the spiral spring such that the torque transmitted by the latter to the mechanical oscillator is substantially constant.

As mentioned above in the present disclosure, the amplitude of the oscillations of the mechanical oscillator, critical for the running accuracy of the movement, is difficult to adjust, especially as it depends on the load state of the secondary spring in a movement of the type comprising a constant force device. The movement according to an embodiment of the present invention thus proposes an adjustment mechanism for the load state of the secondary spring, which is easy to access and to use, which will now be described in association with FIGS. 4, 5*a* and 5*b*.

Figure 4:
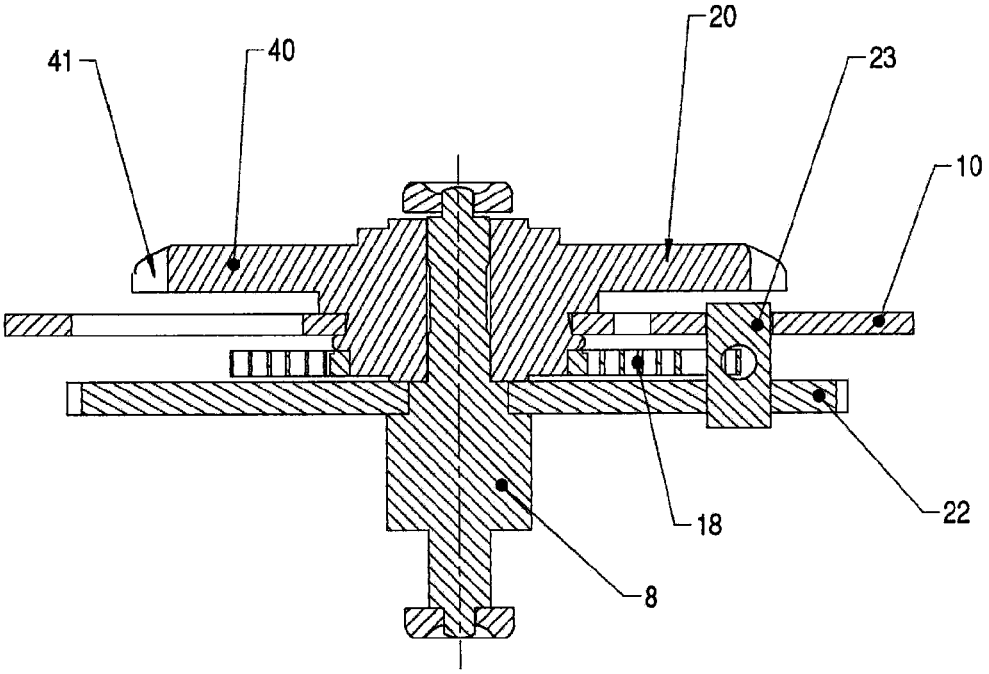
FIG. 4 represents a simplified sectional view of a structural detail of FIG. 3, along the same sectional plane.

FIG. 4 represents the third mobile 9 according to the invention in a cross-sectional view along the same sectional plane as FIG. 3, namely along the plane III-III of FIG. 2.

It is more clearly evident from FIG. 4 that, as previously mentioned, the stop wheel 22 is rotationally fixed to the shaft of the third mobile 9, formed in one piece with the third pinion 8. The adjustment member 20 bearing the inner end of the spiral spring 18 is, for its part, mounted freely on the shaft of the third mobile 9 and bears the third wheel 10.

Thus, during routine working of the clock movement between two successive loads of the spiral spring 18, the latter acts by its inner end upon the adjustment member 20, its outer end being held fixed by the stop wheel 22, in order to rotate the third wheel 10 and maintain the oscillations of the mechanical oscillator.

The load state of the spiral spring 18 can be adjusted by modifying the relative angular positions of its two ends at a given moment in time.

The Applicant has hence had the idea of providing a friction at the level of the connection between the adjustment member 20 and the third wheel 10. This friction is realized in such a way that the adjustment member drives the third wheel during routine working of the movement, while allowing the adjustment member to turn on itself when the third wheel is held fixed by the escapement.

A clockwise rotation of the adjustment member in the view of FIG. 2 thus effects a reduction in the tension of the spiral spring 18, while an anti-clockwise rotation effects an increase in its tension.

In order to facilitate this procedure, it is provided to realize the adjustment member in the form of a shaft fixed to a platform 40 provided with a peripheral toothing 41, defining a bearing surface which can be acted upon in order to make the adjustment member turn on itself more easily.

In addition, a control mobile 42 is likewise provided in a position adjacent to that of the third mobile 9 and contains a toothed pinion 44 arranged to cooperate with the toothing 41 of the adjustment member in order to rotate the latter.

Figure 5A:
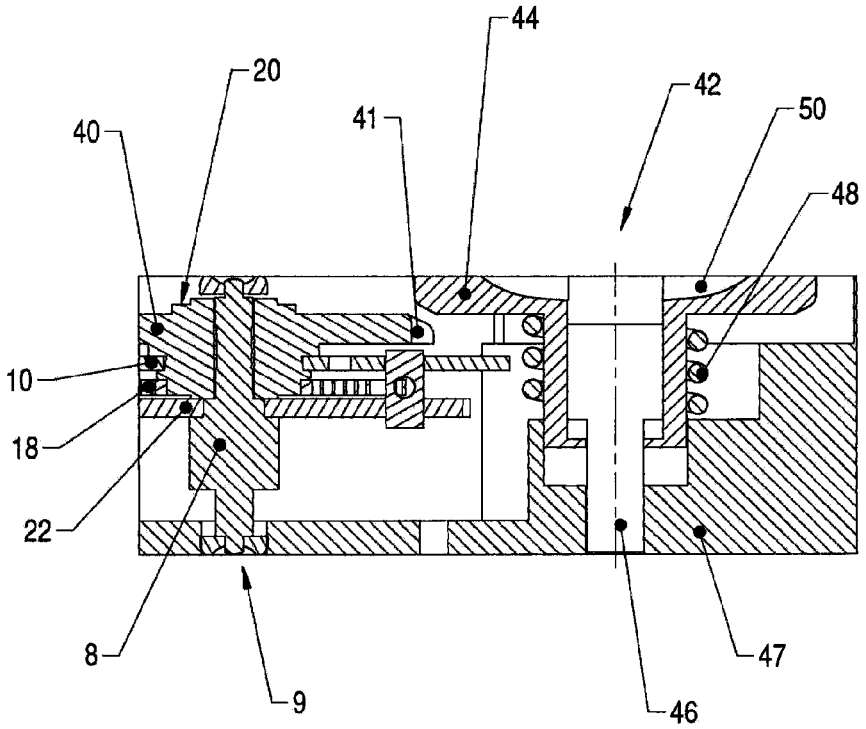
FIGS. 5*a* and 5*b* represent simplified sectional views of the clock movement along the plane IV-IV of FIG. 2, in respective first and second configurations.
Figure 5B:
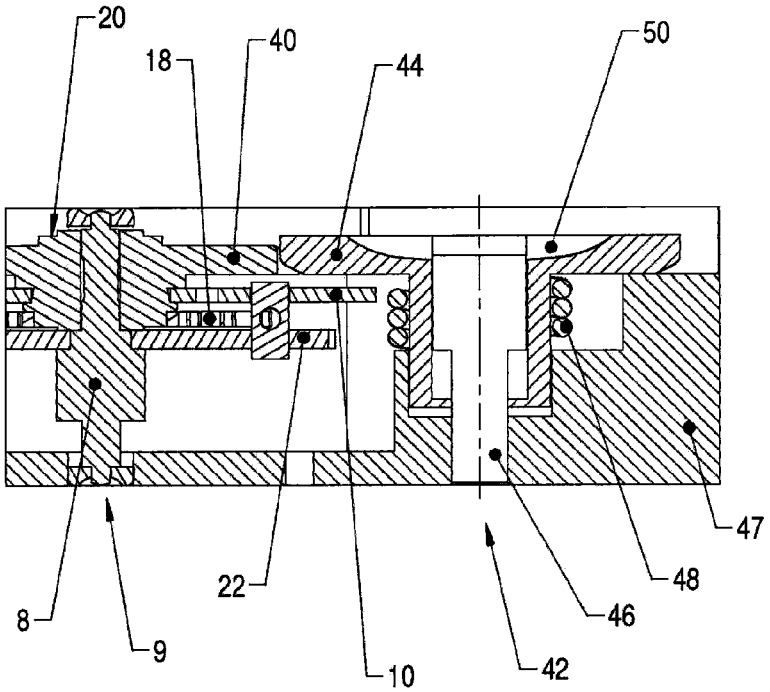

According to one embodiment, the toothed pinion 44 may not be in permanent mesh with the adjustment member so as to limit the losses arising from frictions of the clock movement, as is more clearly evident from FIGS. 5*a* and 5*b*.

The control mobile 42 is mounted pivotably and in a translationally free manner on a foot 46 fixed on an element of the frame 47 of the movement, such as, for example, the main plate, the foot being disposed inside a hollow shaft of the control mobile.

In addition, a helical spring 48 may be disposed between the control mobile and that element of the frame 47 which tends to hold the control mobile in a position distanced from the frame. In this position, represented in FIG. 5*a*, the toothed pinion 44 is not in mesh with the toothing 41 of the adjustment member 20.

When a pressure is applied to the control mobile 42 in the direction of the frame, the spring 48 is compressed and the toothed pinion 44 takes up position within reach of the toothing 41 with which it engages, such as represented in FIG. 5*b*. A rotation of the control mobile 42 in this position then drives a rotation of the adjustment member 20, i.e. a modification of the load state of the spiral spring 18.

It will be noted that the control mobile 42 may be provided with a slot 50 suitable for a procedure with the aid of a tool, such as a screwdriver, to further facilitate the adjustment of the load state of the spiral spring 18 and thus the amplitude of the oscillations of the mechanical oscillator of the clock movement.

Moreover, the clock movement according to an embodiment of the present invention further contains a safety device to avoid unwanted unloading of the spiral spring 18, in particular when the mainspring almost totally runs down to the point of no longer having sufficient energy to reload it. In this case, when no particular precaution is taken, it may be that the spiral spring virtually completely runs down while continuing to deliver energy to the oscillations of the mechanical oscillator once the mainspring is too run down to reload it. It is then advisable to have access to the movement in order to rewind the spiral spring 18 with a tension appropriate for ensuring high running accuracy of the movement, which is crucial. To avoid this situation, the user of a watch provided with such a mechanism must take care to ensure that the mainspring never totally runs down.

As an alternative, the Applicant has developed a safety device by which this problem can be alleviated.

To this end, the third wheel 10 has a particular form, visible in FIG. 2 through the adjustment member 20, represented in transparency: the hub and the rim of the third wheel are connected to each other by means of double arms 100, the function of which is to ensure the frictional connection with the shaft of the adjustment member. It is evident from FIGS. 2 and 3 that the rim of the third wheel 10 additionally bears a material add-on 101 arranged in the plane of the rim and having a receptacle 102 inside which is disposed the stud 23 bearing the outer end of the spiral spring 18. The receptacle 102 is made such that it has an 10 angular aperture substantially equal to or slightly greater than the path travelled by the stud when the stop wheel 22 or the third wheel 10 performs a rotation of twelve degrees. The receptacle 102 thus defines stops limiting displacements of the stud in one direction and the other.

During routine working of the movement, the stud 23 is located close to a first edge of the receptacle 102 when the spiral spring 18 has just been reloaded, while the third wheel 10 travels its path during the following six seconds, such that the stud 23 is located close to the other edge of the receptacle 102 after these six seconds. If, at the moment of the following load, the mainspring no longer has sufficient energy to reload the spiral spring, the stud 23 does not return in the direction of the first edge and thus rapidly forms a stop for the edge of the receptacle situated beside it, blocking the rotational movement of the third wheel, which effects a stoppage of the movement, then, progressively, a stoppage of the oscillations of the mechanical oscillator.

By virtue of these characteristics, the spiral spring 18 always retains its initial load state, namely that which has been attributed to it during factory setting of the movement, thereby easing the burden upon the user of the corresponding watch, who is not compelled to monitor the load state of the mainspring as in the case of movements of the prior art.

As an alternative, it is likewise possible to provide that the stud 23 bearing the outer end of the spiral spring 18 is disposed directly between two arms 100 of one and the same pair, so that that these latter form stops which limit displacements of the stud in one direction and the other. In this case, the spacing between the two arms of this pair is such that it is substantially equal to or slightly greater than the path travelled by the stud when the stop wheel 22 or the third wheel 10 performs a rotation of twelve degrees.

The preceding description focuses on describing one particular embodiment by way of non-limiting illustration and the invention is not limited to the use of certain specific characteristics which have just been described, such as, for example, the form of the members making up the constant force device or even their locations. In fact, the location of the constant force device may be on the third mobile, the Applicant having found that such a location allows the barrel-output torque stresses applied to the device to be limited, while having a negligible disruptive effect upon the working of the mechanical oscillator. Nevertheless, the use of the invention is not limited to such an arrangement and the person skilled in the art will be able to adapt the present teaching to his own needs without departing from the scope of the invention.

The period separating two successive loads of the spiral spring will likewise be able to be modified without departing from the scope of the invention, such that the said period is equal, for example, to ten, twelve or even twenty seconds.

Moreover, it will be noted that embodiments of the present invention are not limited to the use of a friction at the location indicated in the description. In fact, the present invention relates more generally to a clock movement containing a constant force device, comprising a spiral spring, and a train having a first kinematic chain arranged to connect a main energy source to a first end of the spiral spring, and a second kinematic chain for connecting a time base to a second end of the spiral spring, one or other of the first and second kinematic chains containing an adjustment mobile comprising first and second members connected to each other by a friction such that a rotation of one member drives the other member during routine working of the clock movement, one of these members being an adjustment member having at least one bearing surface arranged such that it is possible to act upon it to rotate the adjustment member without rotating the other member by dint of friction, in order to adjust the load state of the spiral spring.

It is thus possible to provide that the third wheel 10 is rigidly connected to the adjustment member 20, which would then no longer be an adjustment member, a friction being alternatively provided between the wheel 14 of the first seconds mobile 13 and the pinion 12 of this mobile. In this case, the load state of the spiral spring could be adjusted by action upon the pinion 12 of the first seconds mobile 13, when the wheel 14 is held fixed by the escapement.

Similarly, it is possible to dispose the stop wheel 22 may be disposed on the center mobile 4 by making it fixed to the shaft, hence to the center pinion 5. In this case, the center wheel 6 can be frictionally mounted on the shaft and can be actuated to adjust the load state of the spiral spring 18. Specific additional trains can likewise be provided as an alternative.

Other embodiments of the present disclosure will be apparent to those skilled in the art from consideration of the specification and practice of the embodiments disclosed herein. It is intended that the specification and examples be considered as exemplary only, with a true scope and spirit of the present disclosure being indicated by the following claims.

What is claimed is:

1. A clock movement comprising:

a constant force device, including a spiral spring, and a train, having a first kinematic chain arranged to connect a main energy source to a first end of said spiral spring and a second kinematic chain for connecting a time base to a second end of said spiral spring, wherein one of said first and second kinematic chains includes an adjustment mobile comprising first and second members connected to each other by a friction such that a rotation of one of said members drives the other member during routine working of the clock movement, and wherein a first of said first and second members is an adjustment member having at least one bearing surface arranged such that a predefined action of a user on said bearing surface drives said adjustment member in rotation without rotating the second of said first and second members by dint of said friction, in order to adjust the load state of said spiral spring.

2. The clock movement of claim 1, wherein said spiral spring is borne by said adjustment mobile, one end of said spiral spring being fixed to said adjustment member.

3. A timepiece provided with a clock movement of claim 2.

4. The clock movement of claim 2, said adjustment mobile comprising a main shaft kinematically connected to said main energy source, a stop wheel rotationally fixed to said shaft and bearing a fixing element fixed to said first end of said spiral spring, said adjustment member having the form of a shaft mounted coaxially and in a freely rotatable manner in relation to said main shaft and having a fixing element for the second end of said spiral spring, said second member, having the form of a drive wheel frictionally mounted on said adjustment member and kinematically connected to said time base.

5. The clock movement of claim 4, said stop wheel and said second member being arranged one relatively to the other such that said fixing element defines a stop limiting their relative rotation movements.

6. A timepiece provided with a clock movement of claim 4.

7. The clock movement of claim 4, said adjustment mobile being a third mobile, said main shaft being a third shaft bearing in a fixed manner a third pinion kinematically connected to said main energy source and said second member being a third wheel arranged in mesh with a seconds mobile, said seconds mobile being arranged in mesh with said time base.

8. The clock movement of claim 7, further comprising a stop device arranged to lock said stop wheel in a predefined angular position and to periodically release it to allow reloading of said spiral spring from said main energy source, according to a predefined amplitude, via said main shaft and said stop wheel.

9. The clock movement of claim 8, said stop wheel having a peripheral toothing arranged to cooperate with a control pallet capable of displacement between first and second end positions, according to the relative angular position of a cam whose rotational movements are driven from a mobile of said train, said stop wheel being arranged so as to be free to turn by a predefined angle during the passage of said control pallet from one to the other of said first and second end positions.

10. The clock movement of claim 4, further comprising a stop device arranged to lock said stop wheel in a predefined angular position and to periodically release it to allow reloading of said spiral spring from said main energy source, according to a predefined amplitude, via said main shaft and said stop wheel.

11. A timepiece provided with a clock movement of claim 10.

12. The clock movement of claim 10, said stop device being arranged to release said stop wheel every six seconds.

13. The clock movement of claim 10, said stop wheel having a peripheral toothing arranged to cooperate with a control pallet capable of displacement between first and second end positions, according to the relative angular position of a cam whose rotational movements are driven from a mobile of said train, said stop wheel being arranged so as to be free to turn by a predefined angle during the passage of said control pallet from one to the other of said first and second end positions.

14. The clock movement of claim 1, said adjustment member having a circular periphery provided with a knurling or a toothing forming said bearing surface.

15. The clock movement of claim 14, further comprising a control mobile adjacent to said adjustment mobile and comprising a toothed pinion capable of cooperating with said bearing surface of said adjustment member.

16. The clock movement of claim 15, said toothed pinion being translationally movable between a first rest position, in which it is disengaged from said bearing surface, and a second adjustment position, in which it engages with said bearing surface.

17. The clock movement of claim 16, said control mobile being provided with at least one slot suitable for cooperating with a tool in order to rotate said toothed pinion.

18. The clock movement of claim 16, wherein said first position is a high position, whilst said second position is a depressed position, said control mobile further comprising an elastic member arranged to hold said toothed pinion in said high position in the absence of any external action.

19. The clock movement of claim 15, said control mobile being provided with at least one slot suitable for cooperating with a tool in order to rotate said toothed pinion.

20. A timepiece provided with a clock movement of claim 1.

* * * * *